United States Patent [19]

Steinhoff

[11] Patent Number: 4,707,936

[45] Date of Patent: Nov. 24, 1987

[54] SNOW PLOW ATTACHMENT

[76] Inventor: Kenneth Steinhoff, 385 S. Wolf Rd., Wheeling, Ill. 60090

[21] Appl. No.: 887,212

[22] Filed: Jul. 21, 1986

[51] Int. Cl.[4] ..... E01H 5/06

[52] U.S. Cl. ..... 37/264; 37/266; 403/14

[58] Field of Search ..... 37/266, 273, 280, 276, 37/281, 264, 265; 403/14, 287, 292

[56] References Cited

U.S. PATENT DOCUMENTS 2,256,953 9/1941 Smith ..... 37/280

FOREIGN PATENT DOCUMENTS 539486 4/1957 Canada ..... 37/266

662664 5/1979 U.S.S.R. ..... 37/266

OTHER PUBLICATIONS

Dearborn Snow Removal Equipment, "Dearborn Blade Snow Plow", 1949.

*Primary Examiner*—Edgar S. Burr

*Assistant Examiner*—Moshe I. Cohen

*Attorney, Agent, or Firm*—Lee, Smith & Zickert

[57] ABSTRACT

An attachment for a snow plow having a normally vertically-oriented snow plow blade. The attachment is composed of a side plate which is installed at an end of the blade. A brace is installed between the blade and the side plate for preventing lateral displacement of the plate, and the plate is immobily secured in place and aligned with the plow blade to assure proper orientation during use.

17 Claims, 5 Drawing Figures

SNOW PLOW ATTACHMENT

BACKGROUND OF THE INVENTION

This invention relates to snow plows, and in particular to an attachment for a snow plow blade at the end thereof to permit accumulation of snow at the blade and inhibit lateral displacement of snow from the blade.

A typical angle-type snow plow is composed of a vertically-oriented snow plow blade and a supporting and adjusting mechanism for attaching the blade to a vehicle. Appropriate adjustment of the blade relative to the direction of travel of the vehicle causes snow to be laterally displaced from the blade, preventing accumulation of snow during the plowing operation.

It is often desirable, particularly when plowing parking lots or any other location where vehicles are present, to remove the snow without permitting lateral displacement of the snow from the blade. If the snow is allowed to accumulate next to a vehicle, it is often "plowed in", requiring a time-consuming and laborious hand-shoveling task to extract the vehicle from the snow plowed about it.

Various devices have been developed for use in conjunction with a snow plow blade for retaining plowed snow. Auxiliary side gates and similar devices are shown in U.S. Pat. Nos. 2,763,944; 2,988,831; 3,055,126; 3,373,515; 3,407,519; 3,422,552; 4,145,825; 4,208,812 and 4,446,639. While the devices of these patents are positionable to inhibit the lateral flow of snow from the snow plow blade, the devices themselves are complex, and are usually moved into operating position by hydraulic or other means, which are subject to failure during the normal cold temperatures and harsh handling experienced by a snow plow.

SUMMARY OF THE INVENTION

The present invention provides a simple, yet effective attachment for a snow plow for temporarily retaining snow against the blade without lateral displacement. The snow plow is of a conventional design, having a vertically-oriented snow plow blade and a supporting and adjusting mechanism for attachment of the blade to a vehicle. The side attachment according to the invention includes a side plate which is shaped to engage an end of the snow plow blade. Guide means for alignment of the side plate and the blade during assembly and use of the attachment are provided, as is means for immobily securing the side plate to an end of the snow plow blade. A brace is provided disposed between the blade and the side plate for preventing lateral displacement of the side plate relative to the blade.

If desired, a pair of the side plates can be used, one of the plates being located at each end of the snow plow blade. Because the side plates are intended to extend to the bottom of the snow plow blade, an edge protection skid is secured to the bottom edge of each plate.

In accordance with the preferred embodiment of the invention, the guide means comprises a pin which is secured to the side plate and a corresponding sleeve which is secured to the blade. The pin engages the sleeve during the assembly of the blade and remains in place during use, to assure proper orientation of the side plate relative to the snow plow blade.

The securing means is composed of a dowel which is attached to the blade and which extends laterally outwardly therefrom. The dowel passes through an aperture in the plate which is formed in alignment with the dowel. A lock pin and washer arrangement is used with the dowel to lock the side plate to the blade. Normally, a pair of such dowels is used, one of the dowels being adjacent the top of the blade and the other of the dowels being adjacent the bottom of the blade.

The brace includes an arm which extends outwardly from and is attached to the side plate. A shoe is secured to the blade, and the arm engages the shoe when the plate is installed on the end of the snow plow blade.

Because of the nature of the invention, and unlike the prior art, the side plate is easily and quickly removed from or attached to the plow blade. Complex hydraulic or other devices are avoided, and the invention is reliable no matter what the temperature or handling conditions may be.

BRIEF DESCRIPTION OF THE DRAWINGS

The invention is described in greater detail in the following description of an example embodying the best mode of the invention, taken in conjunction with the drawings, in which.

DESCRIPTION OF AN EXAMPLE EMBODYING THE BEST MODE OF THE INVENTION

Figure 1:
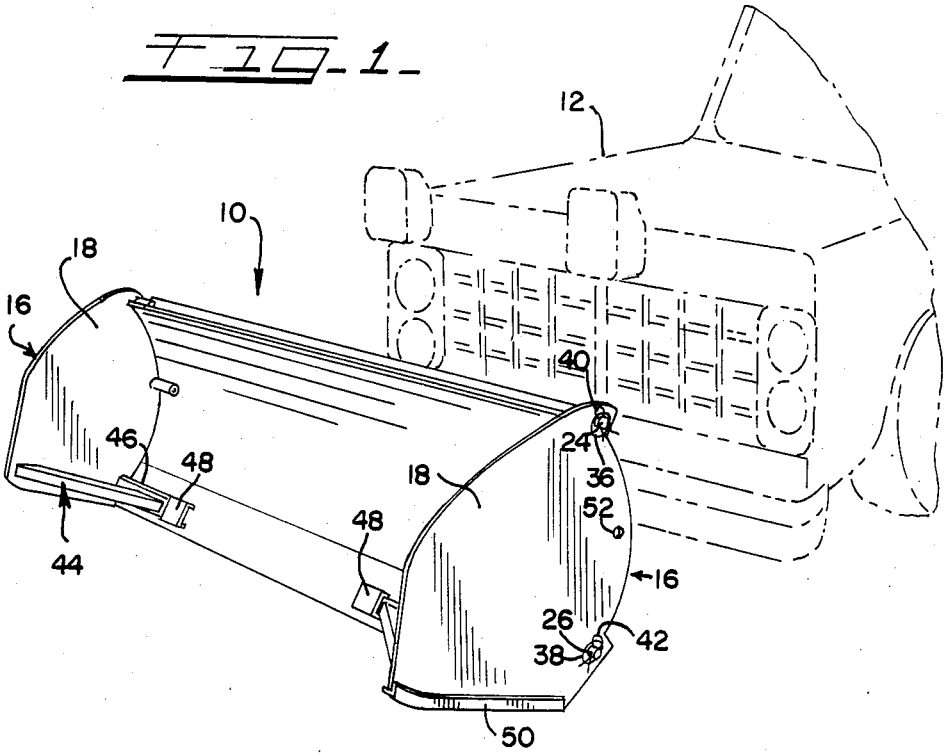
FIG. 1 is a perspective view of a snow plow employing the side attachment according to the invention.

A snow plow incorporating the side attachment according to the invention is shown generally at 10 in FIG. 1. The snow plow 10 is attached to a vehicle 12 by a typical supporting and adjusting mechanism (not illustrated) which permits raising and lowering of the snow plow, and angling of the snow plow during the plowing operation.

The snow plow 10 includes a conventional snow plow blade 14. Attached at either end of the blade is the side attachment 16 according to the invention. Either or both of the side attachments 16 may be employed at one time, and since the side attachments 16 are identical (one being a mirror image of the other), corresponding elements of the side attachment 16 bear the same reference numerals.

Each side attachment 16 is composed of a side plate 18 shaped to engage one end of the blade 14. For alignment of a side plate 18 and the blade 14, each side attachment 16 includes a guide in the form of a pin 20 secured to the side plate 18 and a corresponding sleeve 22 secured to the blade 14. The pin 20 and sleeve 22 are welded or otherwise securely affixed to their corresponding elements of the snow plow 10.

Figure 2:
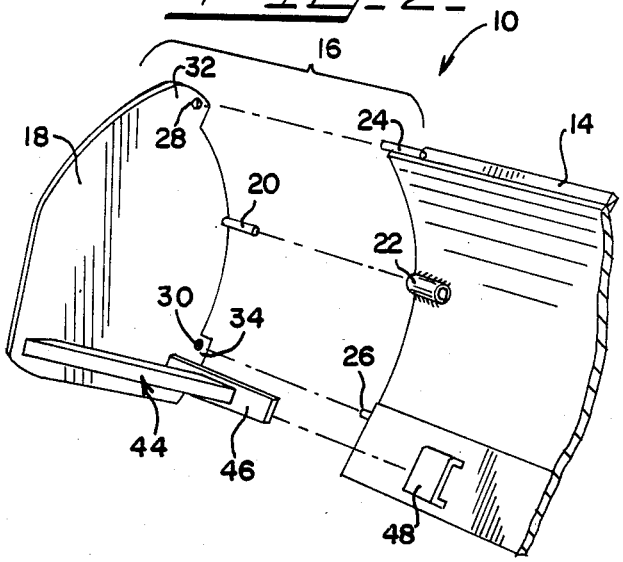
FIG. 2 is an enlarged assembly view, with portions of the snow plow blade omitted, showing the attachment of the right side plate (when viewed from the vehicle) to the snow plow blade.
Figure 4:
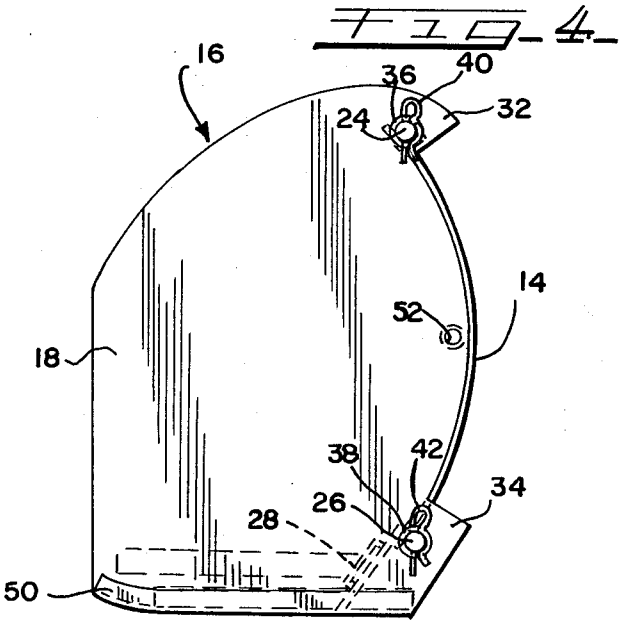
FIG. 4 is a right elevational view of the snow plow attachment of FIG. 3.
Figure 5:
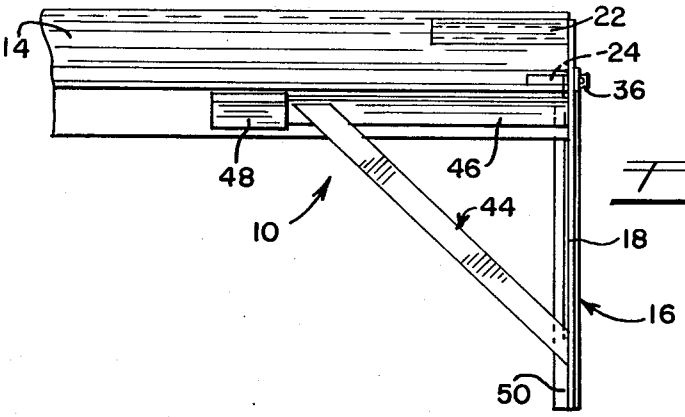
FIG. 5 is a top plan view of the attachment shown in FIG. 3.
Figure 3:
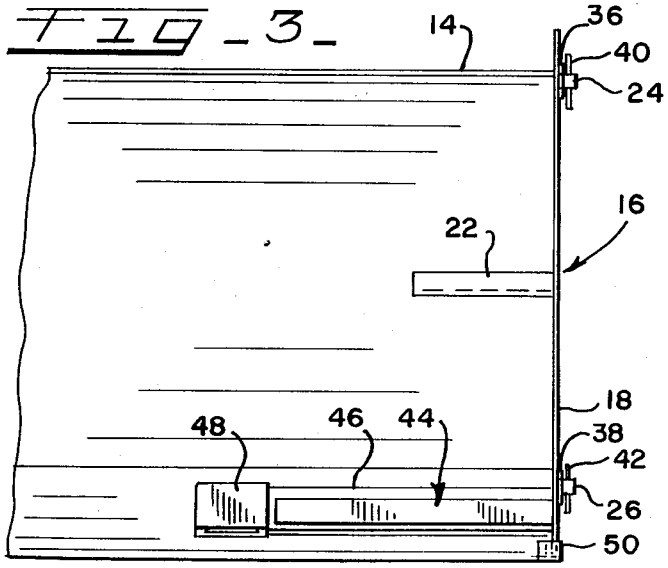
FIG. 3 is a yet further enlarged front elevational view of a side plate attached to the left side of the snow plow.

For securing of a side plate 18 to the blade 14, a pair of dowels 24 and 26 are affixed to the blade 14, extending laterally outwardly therefrom. Corresponding apertures 28 and 30 are formed in the plate 18 in alignment with the respective dowels 24 and 26. As best shown in FIGS. 2 and 4, the apertures 28 and 30 are located in extended ears 32 and 34 of the side plate 18.

The dowels 24 and 26 extend through the side plate 18 sufficently to accomodate respective washers 36 and 38 and lock pins 40 and 42 which are removably secured to the dowels 24 and 26. The lock pins 40 and 42 therefore lock the side plate 18 to the blade 14.

A brace 44 is disposed between the blade 14 and the side plate 18 for preventing lateral displacement of the side plate 18 relative to the blade 14. The brace 44 includes an arm 46 which is attached to and extends outwardly from the side plate 18, engaging a shoe 48 affixed to the blade 14.

As shown in the drawing figures, the vertical extent of each side plate 18 is generally that of the blade 14. To protect against wear at the bottom of the side plate 18, each plate 18 includes an edge protection skid 50 covering the bottom edge of the side plate 18 subjected to road contact.

For strength purposes, it is preferred that all portions of the side attachment 16 are welded to their associated parts of the snow plow 10, whether it be the side plate 18 or the snow plow blade 14. For added bearing strength for the pin 20, the pin 20 may be installed in and welded about a hole 52 in a side plate 18.

Various changes can be made to the invention without departing from the spirit thereof or scope of the following claims.

What is claimed is:

1. In a snow plow having a vertically-oriented snow plow blade and a supporting and adjusting mechanism for attaching the blade to a vehicle, the improvement comprising a side attachment for the blade, the side attachment including a. a side plate shaped to engage an end of the blade, b. guide means for alignment of the side plate and the blade during assembly and use of the side attachment, said guide means comprising a pin secured to said side plate and a corresponding sleeve secured to the blade, c. means separate from said guide means for immobily securing the side plate to an end of the blade, and d. a brace disposed between the blade and the side plate for preventing lateral displacement of the side plate relative to the blade.

2. A snow plow according to claim 1 including a pair of said side plates, one of said plates being located at each end of the blade.

3. A snow plow according to claim 1 including an edge protection skid secured to a bottom edge of said plate.

4. A snow plow according to claim 1 in which said securing means includes a dowel attached to the blade and extending laterally outwardly therefrom, and an aperture in said plate in alignment with said dowel.

5. A snow plow according to claim 4 including a lock pin removably secured to said dowel for locking said side plate to the blade.

6. A snow plow according to claim 4 including a pair of said dowels and corresponding aligned apertures, one of said dowels being adjacent the top of the blade and the other of said dowels being adjacent the bottom of the blade.

7. A snow plow according to claim 6 in which each aperture is located in an extended ear of said side plate.

8. A snow plow according to claim 1 in which said brace includes an arm extending outwardly from and attached to said side plate, said arm engaging a shoe secured to the blade.

9. A side attachment for a snow plow of the type including a verticallyoriented snow plow blade, the side attachment comprising a. a flat side plate shaped to engage an end of the snow plow blade, b. guide means for alignment of the side plate and the snow plow blade during assembly and use of the side attachment, said guide means comprising a pin secured to and extending perpendicular to said side plate and a corresponding sleeve for said pin formed to be attached to the snow plow blade, c. means separate from said guide means for immobily securing the side plate to an end of the snow plow blade, and d. a brace extending outwardly from the side plate and positioned for engaging the snow plow blade to prevent lateral movement of the plate relative to the blade.

10. A side attachment according to claim 9 in which said securing means includes an aperture in said plate and a dowel shaped to pass through said aperture, said dowel being formed for attachment to the snow plow blade.

11. A side attachment according to claim 10 including a lock pin removably secured to said dowel.

12. A side attachment according to claim 10 in which said aperture is located in an extended ear of said side plate.

13. A side attachment according to claim 9 in which said brace includes an arm extending outwardly from and attached to said side plate and including a shoe for securing to the snow plow blade, said arm being shaped to engage said shoe.

14. In a snow plow having a vertically-oriented snow plow blade and a supporting and adjusting mechanism for attaching the blade to a vehicle, the improvement comprising a side attachment for the blade, the side attachment including a. a side plate engaging one end of the blade, b. an alignment pin secured to said side plate and a corresponding sleeve secured to the blade, said pin and sleeve being positioned for alignment of the side plate and the blade during assembly and use of the side attachment, c. a pair of spaced dowels attached to the blade and extending laterally outwardly therefrom, an aperture in said plate in alignment with each of said dowels, and means for securing said dowels within said apertures for immobily securing the side plate to an end of the blade, said dowels being spaced from said pin and sleeve, and d. a brace disposed between the blade and the side plate for preventing lateral displacement of the side plate relative to the blade, said brace engaging a shoe secured to the blade.

15. A snow plow according to claim 14 in which said securing means comprises a lock pin removably secured to said dowel.

16. A snow plow according to claim 14 in which one of said dowels is adjacent the top of the blade and the other of said dowels is adjacent the bottom of the blade.

17. A snow plow according to claim 14 in which each aperture is located in an extended ear of said side plate.

* * * * *